US011851952B2

(12) United States Patent
Yi et al.

(10) Patent No.: US 11,851,952 B2
(45) Date of Patent: Dec. 26, 2023

(54) DOWNHOLE DISPLACEMENT IMPACT METHOD AND IMPACT DRILLING TOOL

(71) Applicant: Yangtze University, Jingzhou (CN)

(72) Inventors: Xianzhong Yi, Jingzhou (CN); Shifan Zhang, Jingzhou (CN); Guangkun Xia, Jingzhou (CN); Xinbo Zhao, Jingzhou (CN); Yanbin Wang, Jingzhou (CN); Yangchuan Ke, Jingzhou (CN); Jifang Wan, Jingzhou (CN); Yuanhua Zhou, Jingzhou (CN)

(73) Assignee: Yangtze University, Jingzhou (CN)

( * ) Notice: Subject to any disclaimer, the term of this patent is extended or adjusted under 35 U.S.C. 154(b) by 0 days.

(21) Appl. No.: 17/860,712

(22) Filed: Jul. 8, 2022

(65) Prior Publication Data

US 2023/0009356 A1 Jan. 12, 2023

(30) Foreign Application Priority Data

Jul. 12, 2021 (CN) ..... 202110786983.6

(51) Int. Cl.
*E21B 1/00* (2006.01)
*E21B 17/042* (2006.01)

(52) U.S. Cl.
CPC ..... *E21B 1/00* (2013.01); *E21B 17/042* (2013.01)

(58) Field of Classification Search
CPC . E21B 17/042; E21B 1/00; E21B 4/16; E21B 4/02; E21B 4/04
See application file for complete search history.

(56) References Cited

U.S. PATENT DOCUMENTS 6,315,063 B1 * 11/2001 Martini ..... E21B 4/00 175/57

* cited by examiner

*Primary Examiner* — Kristyn A Hall
(74) *Attorney, Agent, or Firm* — Crain Caton & James; William P. Jensen

(57) ABSTRACT

A downhole displacement impact method and an impact drilling tool are provided, which relates to the field of drilling tools. The downhole displacement impact drilling tool includes a flow passing sleeve, a first main shaft, an impact-bearing seat, and a second main shaft that are all formed by annular structures and are connected in sequence from top to bottom. A vibration sleeve, a vibration starting seat, and an impact head are connected in sequence from top to bottom on the impact-bearing seat. The vibration sleeve is connected and fixed to the impact head through a connecting sleeve. The vibration starting seat synchronously rotates with the impact-bearing seat through a spline connection therebetween. The vibration starting seat generates an up-down periodic displacement along an axial direction of the vibration starting seat during rotating.

6 Claims, 5 Drawing Sheets

DOWNHOLE DISPLACEMENT IMPACT METHOD AND IMPACT DRILLING TOOL

CROSS REFERENCE TO RELATED APPLICATION

This patent application claims the benefit and priority of Chinese Patent Application No. 202110786983.6 filed on Jul. 12, 2021, the disclosure of which is incorporated by reference herein in its entirety as part of the present application.

TECHNICAL FIELD

The present disclosure relates to the field of drilling tools, in particular, to a downhole displacement impact drilling tool and impact method used for hard stratum drilling in a deep well.

BACKGROUND ART

At present, most drilling methods are belong to a rotary method for breaking a rock and drilling, that is, drilling work is realized by only using a shear force generated by a drilling bit during working. Thus, the rotary method for drilling completes the breaking of the rock. However, for a hard stratum, if the generated torque cannot reach the degree of breaking the rock, the drilling bit stops rotating instantaneously. But if the torque is concentrated to reach the degree of breaking the rock, the torque will be suddenly released, and an impact load that is much larger than usual will be generated on teeth of the drilling bit, which will eventually lead to the failure of the drilling bit.

On the other hand, a deflection moment is easily formed on the drilling bit by only adopting the rotary method for drilling, so as to cause well deflection during drilling, especially when a hard rock and a complex stratum is drilled.

The above situations not only cause great damage to a drilling tool, but also have a great impact on cost investment. Therefore, the improvement of the drilling tool, especially the improvement of a drilling method, has become a difficult problem for designers to solve at present.

SUMMARY

In view of the problems in the prior art, some embodiments provide a new impact drilling tool. That is, the impact drilling tool cooperates with a downhole power motor and a drilling bit to provide two types of rock breaking energy for rotating and displacement impact, so as to be applicable to quick drilling of a hard rock stratum and anti-deflection in drilling of a complex stratum, such as a high and steep structure. Further, the purposes of pressurizing a bottomhole drilling bit in a horizontal well and an extended reach well is achieved, the drilling speed is improved, and the drilling cost is reduced.

A specific solution proposed by the present disclosure is as follows.

A downhole displacement impact drilling tool includes a flow passing sleeve, a first main shaft, an impact-bearing seat, and a second main shaft that are annular and are connected in sequence from top to bottom, wherein a vibration sleeve, a vibration starting seat, and an impact head are connected in sequence from top to bottom on the impact-bearing seat; the vibration sleeve is connected and fixed to the impact head through a connecting sleeve; the vibration starting seat synchronously rotates with the impact-bearing seat through a spline connection therebetween; and the vibration starting seat generates an up-down periodic displacement along an axial direction of the vibration starting seat during rotating.

Further, an intermediate joint is arranged between the first main shaft and the impact-bearing seat; and the first main shaft is threadedly connected and rotates synchronously with the impact-bearing seat through the intermediate joint.

Further, a spacing space is formed between an end surface, which is connected to the impact-bearing seat, of the intermediate joint and the vibration sleeve arranged on the impact-bearing seat; and a spring is mounted in the spacing space.

Further, an outer wall of the vibration sleeve and an outer wall the impact head are each mounted with steel balls; the steel balls are configured for supporting the vibration sleeve and the impact head; a second shell is also arranged to surround the steel balls; and one end of the second shell is in threaded connection with the intermediate joint.

Further, a Polycrystalline Diamond Compact (PDC) bearing moving ring, a PDC bearing stationary ring, a lower cemented carbide (TC) moving ring, a lower TC stationary ring, and a lower joint are sleeved on a junction between the impact-bearing seat and the second main shaft in sequence; the PDC bearing stationary ring is stationary; and the PDC bearing moving ring and the second main shaft rotate together.

Further, a TC radial bearing and a rolling ball bearing configured for supporting the first main shaft are mounted on an outer side of the first main shaft from top to bottom; and the TC radial bearing is in locking connection with the rolling ball bearing through main shaft locking nuts.

Further, the rolling ball bearing comprises an inner ring, an outer seating ring, and steel balls; and an arc roller path is formed in each of the inner ring and the outer ring of the rolling ball bearing.

Further, a first shell is also arranged to surround the TC radial bearing and the rolling ball bearing; the first shell is in threaded connection with the intermediate joint; and the first shell, the intermediate joint, and the second shell are subjected to quenching and tempering treatment to have the hardness within the HB range of 250 to 290, and are subjected to blackening treatment.

Further, the vibration starting seat is a displacement bearing comprising an upper vibration starting body and a lower vibration starting body; and pitch expansion lines of a rolling ball groove of the upper vibration starting body of the vibration starting seat have at least one of four structures of a sine or cosine harmonic groove shape, a sawtooth groove shape, a rectangular groove shape, and a triangular groove shape.

Further, a spray nozzle is also arranged at one end, close to the first main shaft, of the impact-bearing seat. The spray nozzle is used for assisting a jet velocity effect and realizing an automatic pushing function.

A method for generating an impact by a drilling tool is that the vibration starting seat generates axial displacement and transfers the displacement to the drilling bit to generate the impact. The upper vibration starting body is in contact with the vibration sleeve. The lower vibration starting body is in contact with a connecting sleeve.

Grooves are formed in the upper vibration starting body. The expansion lines of pitch circles of the grooves have at least one of four groove shapes of a sine or cosine harmonic groove shape, a sawtooth groove shape, a rectangular groove shape, and a triangular groove shape.

Even grooves are formed in the lower vibration starting body. Two rolling balls are embedded into the even grooves. Relative positions of the rolling balls are kept by retainers.

When the lower vibration starting body rotates relative to the upper vibration starting body, the rolling balls in the lower vibration starting body move in uneven grooves of the upper vibration starting body, which is equivalent to that the displacement of the rolling balls perpendicular to an irregular surface of the uneven grooves will be generated when the rolling balls move on the irregular surface (the displacement of the rolling balls generated here is an axial displacement); and when the rolling balls in the lower vibration starting body move towards convex areas of the grooves of the upper vibration starting body, due to the pressing force between the rolling balls and the surfaces of the grooves of the upper vibration starting body, the vibration starting seat will generate axial displacement, and meanwhile, the spring is elongated to store energy. This axial displacement will be transferred to the impact head through the connecting sleeve. The impact head will generate an impact on the impact-bearing seat. Finally, the impact is transferred to the drilling bit. When the rolling balls in the lower vibration starting body move towards concave areas of the grooves of the upper vibration starting body, due to the disappearance of a pressing force between the rolling balls and groove surfaces, the spring pulls the upper vibration starting body to be close to the lower vibration starting body to release energy. Meanwhile, the impact head, the impact-bearing seat, and the drilling bit are pushed back to original positions, so as to complete an impact process.

The beneficial effects achieved by adopting some embodiments are that:

1. The drilling tool is powered by using a turbine motor, a screw motor, an electric motor, and the like, has good high temperature resistance, and will not cause a centrifugal inertia force and transverse vibration.
2. The drilling tool can apply a torsional impact force with a low amplitude and a high frequency to the drilling bit, so as to reduce a stick-slip phenomenon of the drilling bit, and greatly improve the rate of drilling.
3. By periodically providing the torsional impact force for the drilling bit, a torque can be stably transferred to the drilling bit, which reduces the possibility of drilling bit failure caused by sticking the drilling bit, reduces the costs of tripping and operating the drilling bit, and improves comprehensive technical and economic benefits.
4. Difficult problems in hard rock drilling during the oil drilling can be comprehensively solved, the hard rock drilling speed can be effectively improved, the drilling deflection problems in the drilling of the hard rock stratum and the complex stratum are prevented, the drilling cost is reduced, and the bottomhole pressurization of the horizontal well and the extended reach well are realized.
5. An impact force with a high frequency periodicity can act together with static pressure rotation to break the rock.

Figure 1:
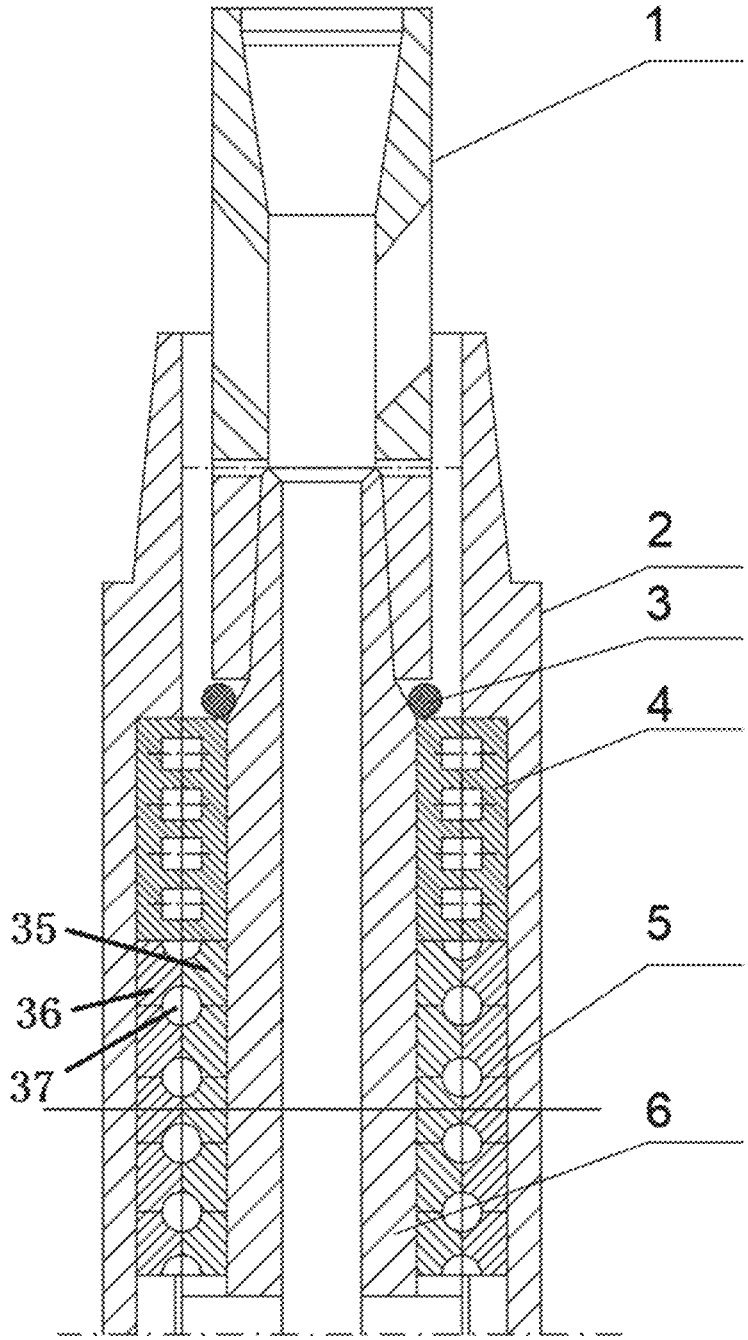
FIG. 1 illustrates a schematic structural diagram of an upper part of a downhole displacement impact drilling tool according to an embodiment of the present disclosure.

Reference signs in the drawings: 1 flow passing sleeve; 2 first shell; 3 main shaft locking nut; 4 TC radial bearing; 5 rolling ball bearing; 6 first main shaft; 7 intermediate joint; 8 spline sleeve; 9 spray nozzle; 10 spring; 11 second shell; 12 vibration sleeve; 13 vibration starting seat; 14 connecting sleeve; 15 impact head; 16 impact-bearing seat; 17 spacer sleeve; 18 PDC bearing moving ring; 19 PDC bearing stationary ring; 20 lower TC moving ring; 21 lower TC stationary ring; 22 lower joint; 23 second main shaft; 31 circlip for hole-type A; 32 steel ball; 33 upper vibration starting body; 34 pitch expansion line, 35 inner ring; 36 outer seating ring; 37 arc roller path; and 38 space.

DETAILED DESCRIPTION OF THE EMBODIMENTS

The following describes the principles and features of the present disclosure in combination with accompanying drawings. The examples cited are only used for explaining the present disclosure and are not intended to limit the scope of the present disclosure.

In view of the technical problems that the damage to a drilling tool and great cost investment are easily caused since there is only a rotary method in the prior art, a downhole displacement impact drilling tool is designed. The drilling tool has the characteristics of compact structure and high energy intensity, and can realize bottomhole pressurization of a horizontal well and an extended reach well, and generate an impact force with a high frequency periodicity to act together with static pressure rotation to break a rock. Therefore, difficult problems in hard rock drilling during oil drilling can be comprehensively solved, and drilling deflection situations in the drilling of a hard rock stratum and a complex stratum are prevented. So, the purposes of prolonging the service life of a drilling bit and reducing the damage to the drilling tool are achieved to reduce the drilling cost.

Figure 2:
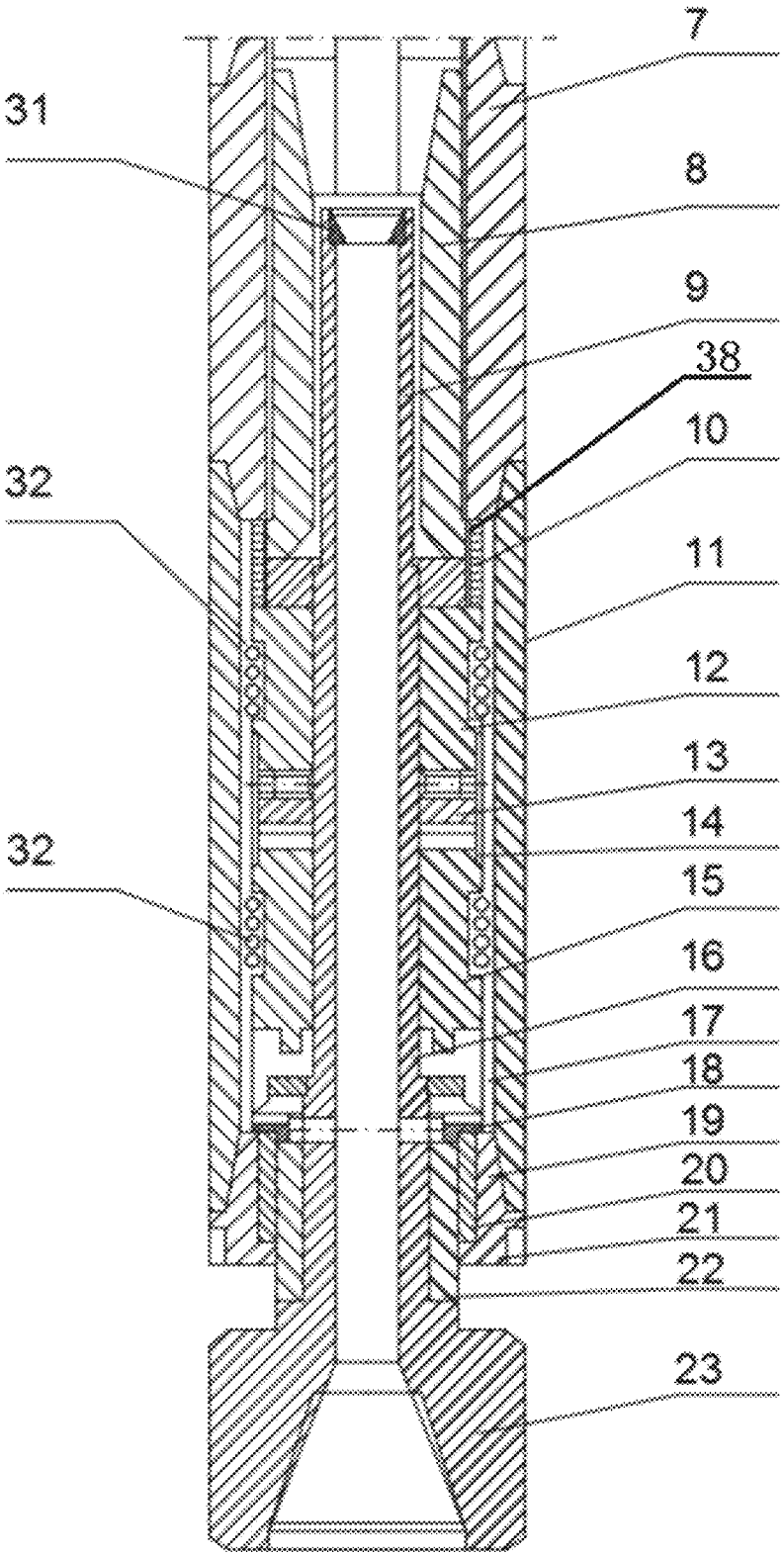
FIG. 2 illustrates a schematic structural diagram of a lower part of a downhole displacement impact drilling tool according to an embodiment of the present disclosure.
Figure 3:
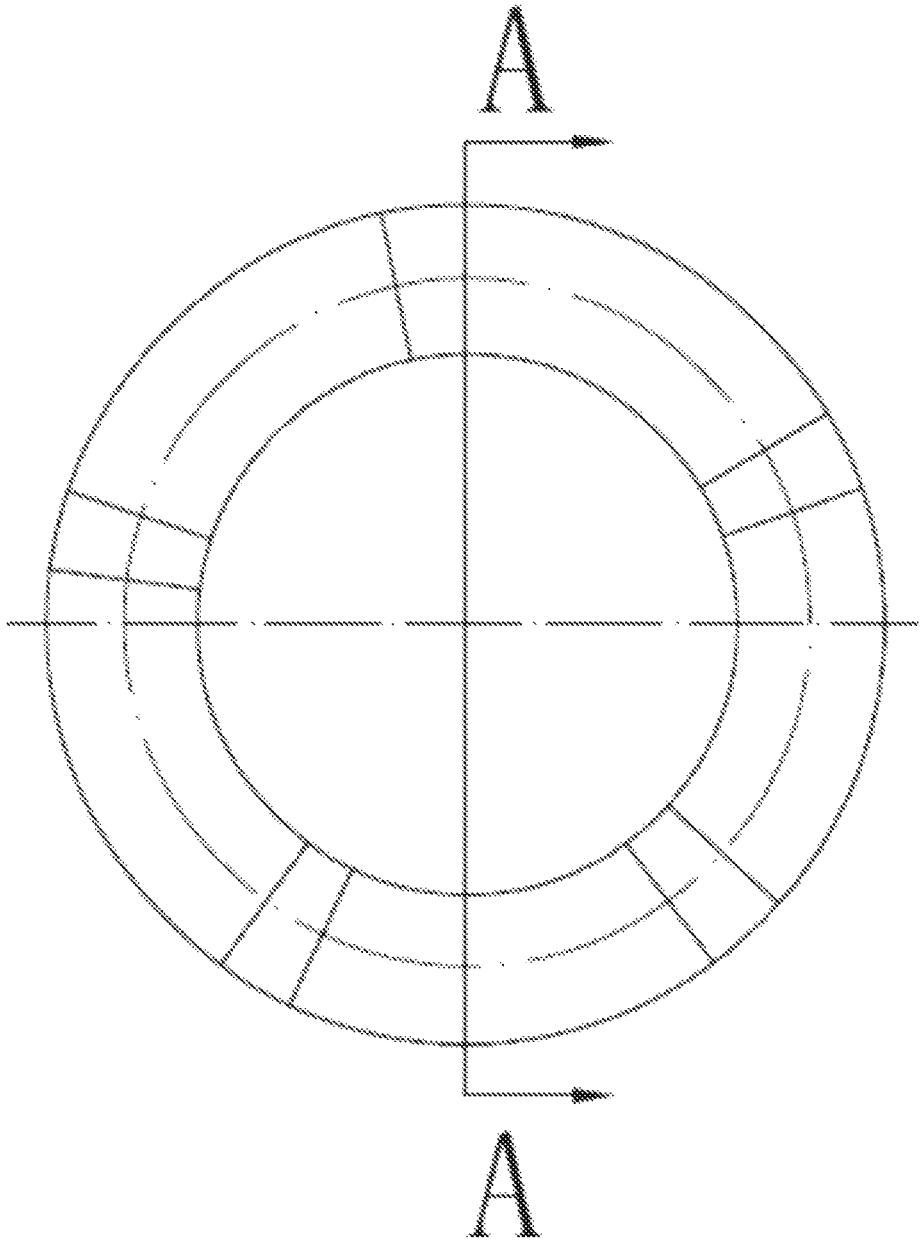
FIG. 3 illustrates a partial schematic diagram of a ball groove of an upper vibration starting body of a vibration starting seat.
Figure 4:
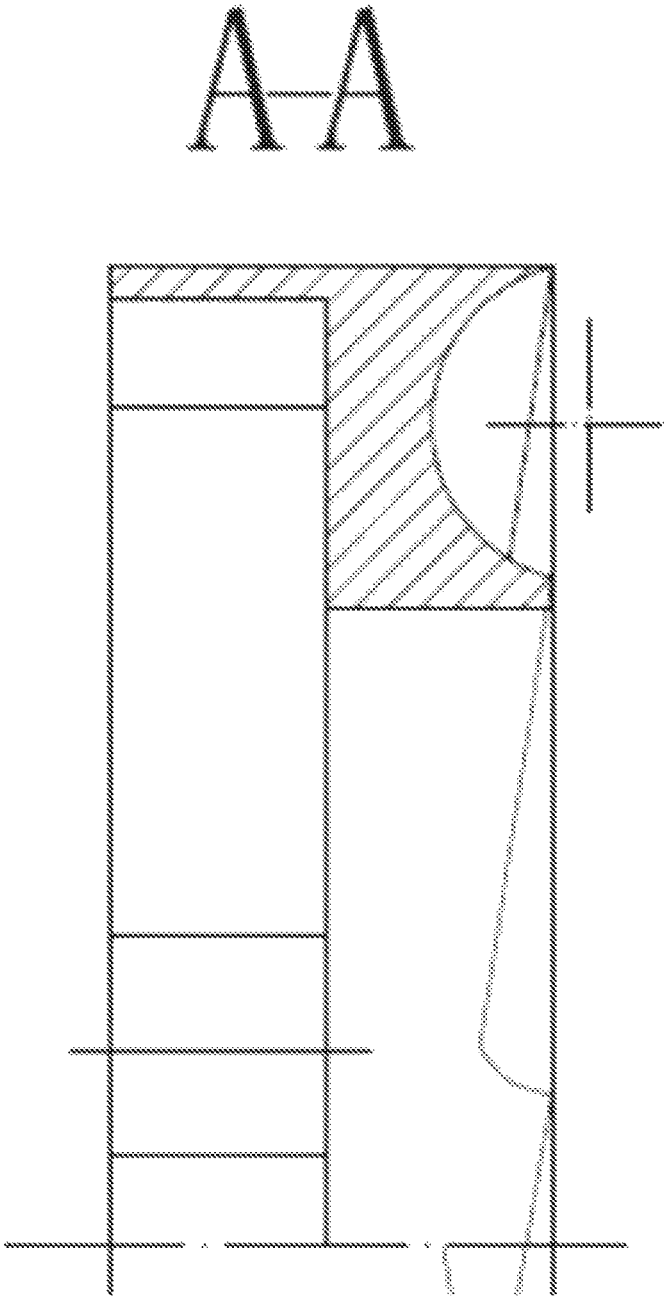
FIG. 4 illustrates a schematic cross-section view of A-A in FIG. 3, which shows a cross section of the upper vibration starting body.
Figure 5:
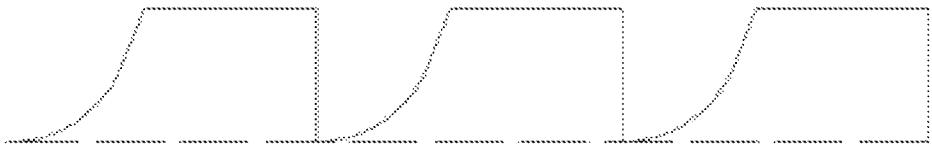
FIG. 5 illustrates a schematic diagram of sawteeth of a pitch expansion line, which is of a rectangular groove-shaped structure, of a rolling ball groove of an upper vibration starting body of a vibration starting seat.
Figure 6:
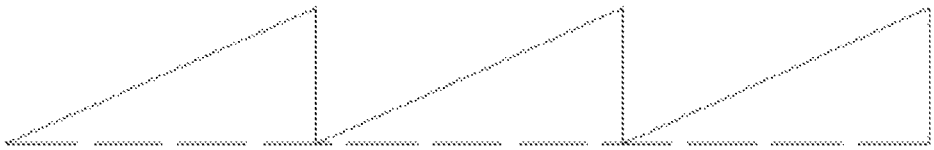
FIG. 6 illustrates a schematic structural diagram of a pitch expansion line, which is of a triangular groove-shape structure, of the rolling ball groove of the upper vibration starting body of the vibration starting seat.
Figure 7:
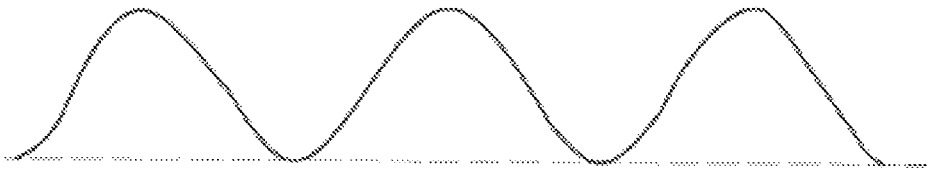
FIG. 7 illustrates a schematic structural diagram of a pitch expansion line, which is of an oblique wave groove-shape structure, of the rolling ball groove of the upper vibration starting body of the vibration starting seat.
Figure 8:
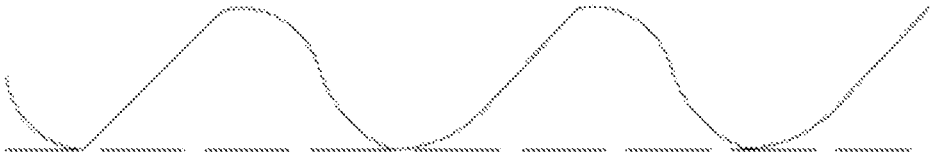
FIG. 8 illustrates a schematic structural diagram of a pitch expansion line, which is of a toothed groove-shape structure, of the rolling ball groove of the upper vibration starting body of the vibration starting seat.

Specifically, referring to FIG. 1 to FIG. 2, the downhole displacement impact drilling tool includes a flow passing sleeve 1, a first main shaft 6, an impact-bearing seat 16, and a second main shaft 23 that are annular and are connected in sequence from top to bottom. The first main shaft 6, the impact-bearing seat 16, and the second main shaft 23 are hollow, and are used for transporting the mud flowing from the flow passing sleeve 1. An outer wall of the impact-bearing seat 16 is connected to a vibration sleeve 12, a vibration starting seat 13, and an impact head 15 in sequence from top to bottom. The vibration sleeve 12 is connected and fixed to the impact head 15 through a connecting sleeve 14. The vibration starting seat 13 realizes synchronous rotation with the impact-bearing seat 16 in a spline connecting mode. The vibration starting seat 13 generates up-down periodic displacement in the axial direction thereof during rotating.

It can be understood that, the drilling tool breaks the rock by using two modes of rotating energy and impact energy.

The rotating energy of the drilling tool is transferred through the flow passing sleeve 1 and the first main shaft 6. The first main shaft 6 is connected to a power output shaft of a downhole power motor (not shown) through the flow passing sleeve 1 to provide power input, thereby providing mechanical energy for rotary motion. Optionally, the downhole power motor for providing power may include a plurality of motors, such as a turbine motor, a screw motor, or an electric motor.

The impact energy of the drilling tool is generated by the vibration starting seat 13. The vibration starting seat 13 generates periodically varying axial displacement under the rotation of the second main shaft 23, so as to form an original basis of the impact. The frequency of the displacement is sawteeth-shaped or harmonic-shaped. A spring 10 (introduced hereinafter) is used for generating the impact force in the axial direction. A lower end of the second main shaft 23 is connected to a drilling bit, so as to provide displacement impact movement for the drilling bit, and form the output of impact type mechanical energy.

The drilling tool makes the drilling bit break the rock by using two modes of rotating and displacement impact by the combined work of the downhole power motor and the drilling bit, so that the drilling bit is protected and the drilling speed is improved.

Composition structures of the downhole displacement impact drilling tool mentioned in the present solution are introduced in detail below.

The downhole displacement impact drilling tool mainly includes a flow passing sleeve 1, a first shell 2, a main shaft locking nut 3, a TC radial bearing 4, a rolling ball bearing 5, a first main shaft 6, an intermediate joint 7, a spline sleeve 8, a spray nozzle 9, a spring 10, a second shell 11, a vibration sleeve 12, a vibration starting seat 13, a connecting sleeve 14, an impact head 15, an impact-bearing seat 16, a spacer sleeve 17, a PDC bearing moving ring 18, a PDC bearing stationary ring 19, a lower TC moving ring 20, a lower TC stationary ring 21, a lower joint 22, a second main shaft 23, a circlip for hole-type A 31, and a steel ball 32.

The flow passing sleeve 1 is used for receiving the mud flowing from the downhole power motor (not shown). The lower end of the flow passing sleeve 1 is in threaded connection with the first main shaft 6. The upper end of the flow passing sleeve 1 is in thread connection with the downhole power motor, such as a turbine motor, a screw motor, or an electric motor.

The TC radial bearing 4 and the rolling ball bearing 5 are mounted on the first main shaft 6 to support. The main shaft locking nut 3 is used for locking the TC radial bearing 4 and the rolling ball bearing 5 mounted on the first main shaft 6.

Optionally, the surface of the TC radial bearing 4 is plated with a hard alloy. That is, an inner surface and an outer surface of the TC radial bearing 4 are regularly plated with additives such as cemented carbide blocks, a solder of special components, and cemented carbide, which are fused with the TC radial bearing 4 integrally through special sintering treatment.

In the present embodiment, the rolling ball bearing 5 includes an inner ring 35, an outer seating ring 36, and steel balls. An arc roller path 37 is formed in each of the inner ring 35 and the outer seating ring 36 of the rolling ball bearing 5. Five to thirteen pairs of rolling ball bearings 5 form a group, so that the rolling ball bearings 5 can bear a large axial load, and the overall structure is compact, the occupied space of the rolling ball bearings 5 is small, and bidirectional load can also be born by the rolling ball bearings 5. During work, rolling ball bearing 5 is lubricated by using mud, which reduces the wear of the rolling ball bearings 5. The mud is mainly transferred to the drilling bit through the first main shaft and the second main shaft, and a certain allowable gap is presented between the first main shaft and the second main shaft in the axial direction thereof.

The first shell 2, the intermediate joint 7, and the second shell 11 are connected in sequence in a threaded mode; and the upper part of the first shell 2 is connected to the downhole power motor described hereinabove.

In the present embodiment, the first shell 2, the intermediate joint 7, and the second shell 11 are subjected to quenching and tempering treatment to reach the hardness within the HB range of 250 to 290, and then are subjected to blackening treatment. The first shell 2 and the second shell 11 are used for realizing axial and radial positioning of internal parts, so that it can ensure that the internal parts can withstand the flexure and longitudinal bending caused by axial load and transverse stress.

In the present embodiment, a blade may be mounted on the first shell 2 and/or the second shell 11. The blade serves as a stabilizer, which can meet the requirement of preventing well deflection when a straight well is drilled, and can achieve an effect of controlling the trajectory of a borehole when a directional well is drilled. So, the working stability of the drilling bit may be improved, and the service life of the drilling bit may be prolonged.

A space 38 is formed between an end surface, which is connected to the impact-bearing seat 16, of the intermediate joint 7 and the vibration sleeve 12 arranged on the impact-bearing seat 16. A spring 10 is mounted in the space 38. The spring 10 stores and releases energy through continuous elongation and compression. It can be understood that the intermediate joint 7 is elastically connected to the vibration sleeve 12 through the spring 10. The vibration sleeve 12, the connecting sleeve 14, and the impact head 15 are mounted in the axial direction of the impact-bearing seat 16, and can transfer the impact generated by the spring 10.

The steel balls 32 mentioned hereinabove are respectively mounted on the outer sides of the vibration sleeve 12 and the impact head 15, and are used for supporting the vibration sleeve 12 and the impact head 15.

It can be understood that the vibration sleeve 12 is connected to the impact-bearing seat 16 and can rotate together with the impact-bearing seat 16. The connecting sleeve 14 is connected and fixed to the vibration sleeve 12. The vibration sleeve 12 transfers the impact force to the impact head 15 through the connecting sleeve 14. The impact head 15 generates an impact on the impact-bearing seat 16. The impact-bearing seat 16 transfers rotation movement to the second main shaft 23 in a form of key through a spline sleeve 8, and further transfers to the drilling bit, so that the drilling bit rotates.

Optionally, the PDC bearing moving ring 18 and the PDC bearing stationary ring 19 are sleeved on the impact-bearing seat 16. The PDC bearing moving ring 18 and the PDC bearing stationary ring 19 are mounted on the impact-bearing seat 16 and can slide relative to each other. The PDC bearing moving ring 18 and the PDC bearing stationary ring 19 are used for supporting the impact-bearing seat 16. The PDC bearing moving ring 18 and the second main shaft 23 rotate together, and the PDC bearing stationary ring 19 is kept stationary. The lower joint 22 realizes the sealing of the second main shaft 23.

In the present embodiment, referring to FIG. 3 to FIG. 8, the vibration starting seat 13 is connected to the second main shaft 23 in a form of key. The vibration starting seat 13 is a displacement bearing including an upper vibration starting body 33 and a lower vibration starting body. The material of the vibration starting seat 13 is 55SiMoVA, and the heat treatment hardness of the vibration starting seat 13 is within the HRC range of 54 to 57. And, non-destructive testing and pickling inspection are performed on the vibration starting seat 13 after coarse grinding on the vibration starting seat 13, and then tempering treatment is performed on the vibration starting seat 13. The vibration starting seat 13 includes the upper vibration starting body 33 and the lower vibration starting body, which can generate axial displacement. The pitch expansion lines 34 of the rolling ball grooves of the upper vibration starting body 33 of the vibration starting seat 13 have at least one of four structures of a sine or cosine harmonic groove shape, a sawtooth groove shape, a rectangular groove shape, and a triangular groove shape. The numbers of grooves corresponding to the four structures can vary, and can be 2, 3, 4, 5, 6 or more.

A spray nozzle 9 is also arranged at one end, which is close to the first main shaft 6, of the impact-bearing seat 16. The spray nozzle 9 achieves an effect of automatically pushing the overall drilling tool, and can improve an assistant jet effect of the drilling bit. So, an impact force of a jet on the bottom of a well is greatly improved without increasing the power of a surface pump.

A specific working method of the downhole displacement impact drilling tool is described below.

When the downhole power motor (such as a turbine motor, a screw motor, or an electric motor) rotates, the first main shaft 6, the impact-bearing seat 16, and the second main shaft 23 are be driven to rotate through the flow passing sleeve 1, and a drilling bit connected to the second main shaft 23 applies a pressure to a stratum, so as to break a rock. Simultaneously, the vibration starting seat 13 rotates together with the second main shaft 23 and the impact-bearing seat 16 under the connection of the spline. At this moment, the vibration starting seat 13 generates axial displacement during rotating, so as to drive the impact-bearing seat 16 to move up and down periodically in an axial direction thereof.

When the axial displacement, which is a distance between the lower vibration starting body and the vibration starting body, of the vibration starting seat 13 increases, the displacement drives the connecting sleeve 14, and the connecting sleeve 14 moves in an axis direction to drive the vibration sleeve 12 to move in the axial direction to include the spring 10. So, the spring 10 can store energy, and meanwhile, the impact-bearing seat 16 and the spline sleeve are connected more tightly.

When the axial displacement of the vibration starting seat 13 decreases, the impact-bearing seat 16 is driven to move downwards along the axis thereof, and the energy stored in the spring 10 is released continuously. Since the radial displacement velocity of the rolling balls in the vibration starting seat 13 are not uniform, so that the spring does not elongate uniformly during releasing the energy, and a periodic impact is generated on the vibration sleeve 12.

The vibration sleeve 12 transfers the impact force to the impact head 15 through the connecting sleeve 14, and the impact head 15 generates impact on the impact-bearing seat 16. The impact-bearing seat 16 transfers the impact force to the drilling bit, so that the impact force of the drilling bit acting on a rock layer changes periodically.

Of course, during drilling, a part of the mud moves in the axis direction of the flow passing sleeve 1, the first main shaft 6, the impact-bearing seat 16, and the second main shaft 23 to drive the drilling bit to break the rock; another part of the mud lubricates the TC radial bearing 4 and the rolling ball bearing 5; and yet another part of the mud directly generates impact on the vibration sleeve 12 together with the spring 10 and can be used for lubricating the steel balls 32.

An observation hole is formed at connection threads of the flow passing sleeve 1 and the first main shaft 6, and is used for observing whether the connection threads are screwed in place during assembling. The main shaft locking nut 3 is used for limiting the positions of the TC radial bearing 4 and the rolling ball bearing 5 on the first main shaft 6. The upper part of the first shell 2 is used for connecting the motor in the forms of a turbine motor, a screw motor, an electric motor, or the like. The first shell 2, the intermediate joint 7, and the second shell 11 are used for positioning the drilling tool in the axial direction and the radial direction, can withstand the flexure and longitudinal bending caused by axial load and transverse stress, and are formed by drilling and boring a high-quality forged steel bar. And, inner holes of the first shell 2, the intermediate joint 7, and the second shell 11 are formed by heat treatment and finish grinding.

The blade may be mounted on the first shell 2, which serves as a stabilizer. The requirement of preventing well deflection when a straight well is drilled can be met, an effect of controlling the trajectory of a borehole when a directional well is drilled can be achieved, and the working stability of the drilling bit can also be improved, thereby prolonging the service life of the drilling bit.

The above is merely preferred embodiments of the present disclosure and is not intended to limit the present disclosure. Any modifications, equivalent replacements, improvements and the like made within the spirit and principle of the present disclosure shall fall within the scope of protection of the present disclosure.

What is claimed is:

1. A downhole displacement impact drilling tool, comprising a flow passing sleeve, a first main shaft, an impact-bearing seat, and a second main shaft that are annular and are connected in sequence from top to bottom, wherein a vibration sleeve, a vibration starting seat, and an impact head are connected in sequence from top to bottom on the impact-bearing seat; the vibration sleeve is connected and fixed to the impact head through a connecting sleeve; the vibration starting seat synchronously rotates with the impact-bearing seat through a spline connection therebetween; and the vibration starting seat generates an up-down periodic displacement along an axial direction of the vibration starting seat during rotating, wherein an intermediate joint is arranged between the first main shaft and the impact-bearing seat, and the first main shaft is threadedly connected and rotates synchronously with the impact-bearing seat through the intermediate joint; and wherein a space is formed between an end surface, which is connected to be the impact-bearing seat of the intermediate joint and the vibration sleeve arranged on the impact-bearing seat; and a spring is mounted in the space.

2. The downhole displacement impact drilling tool according to claim 1, wherein an outer wall of the vibration sleeve and an outer wall the impact head are each mounted with steel balls; the steel balls are configured for supporting the vibration sleeve and the impact head; a second shell is also arranged to surround the steel balls; and one end of the second shell is in threaded connection with the intermediate joint.

3. The downhole displacement impact drilling tool according to claim 2, wherein a Polycrystalline Diamond Compact (PDC) bearing moving ring, a PDC bearing stationary ring, a lower cemented carbide (TC) moving ring, a lower TC stationary ring, and a lower joint are sleeved on a junction between the impact-bearing seat and the second main shaft in sequence; the PDC bearing stationary ring is stationary; and the PDC bearing moving ring and the second main shaft rotate together.

4. The downhole displacement impact drilling tool according to claim 3, wherein a TC radial bearing and a rolling ball bearing configured for supporting the first main shaft are mounted on an outer side of the first main shaft from top to bottom; and the TC radial bearing is in locking connection with the rolling ball bearing through main shaft locking nuts.

5. The downhole displacement impact drilling tool according to claim 4, wherein the rolling ball bearing comprises an inner ring, an outer seating ring, and steel balls; and an arc roller path is formed in each of the inner ring and the outer ring of the rolling ball bearing.

6. The downhole displacement impact drilling tool according to claim 5, wherein a first shell is also arranged to surround the TC radial bearing and the rolling ball bearing; the first shell is in threaded connection with the intermediate joint; and the first shell, the intermediate joint, and the second shell are subjected to quenching and tempering treatment to have the hardness within the HB range of 250 to 290, and are subjected to blackening treatment.

* * * * *